US007819223B2

(12) United States Patent
Celik et al.

(10) Patent No.: US 7,819,223 B2
(45) Date of Patent: Oct. 26, 2010

(54) SILENCER FOR ADSORPTION-BASED GAS SEPARATION SYSTEMS

(75) Inventors: Cem E. Celik, Tonawanda, NY (US); James Smolarek, Boston, NY (US); Michael Victor Barsottelli, Elma, NY (US)

(73) Assignee: Praxair Technology, Inc., Danbury, CT (US)

( * ) Notice: Subject to any disclaimer, the term of this patent is extended or adjusted under 35 U.S.C. 154(b) by 814 days.

(21) Appl. No.: 11/395,140

(22) Filed: Apr. 3, 2006

(65) Prior Publication Data

US 2007/0227813 A1 Oct. 4, 2007

(51) Int. Cl.

| | |
|---|---|
| ***F01N 1/08*** | (2006.01) |
| ***F01N 1/10*** | (2006.01) |
| ***F01N 1/02*** | (2006.01) |
| *F01N 1/00* | (2006.01) |

(52) U.S. Cl. ..... 181/272; 181/268; 181/275; 96/381; 96/384

(58) Field of Classification Search ..... 181/272, 181/269, 268, 275, 257, 232, 270, 224, 225; 96/380, 381, 384, 385, 130

See application file for complete search history.

(56) References Cited

U.S. PATENT DOCUMENTS

| | | | | | |
|---|---|---|---|---|---|
| 1,891,170 | A | * | 12/1932 | Toichi et al. | 60/295 |
| 1,964,845 | A | * | 7/1934 | Dietze et al. | 454/206 |
| 2,308,886 | A | * | 1/1943 | Mason | 181/224 |
| 2,896,849 | A | * | 7/1959 | Argentieri et al. | 236/13 |
| 2,998,860 | A | * | 9/1961 | Everett | 181/257 |
| 3,187,837 | A | * | 6/1965 | Beeching | 181/246 |
| 3,530,649 | A | * | 9/1970 | Shelton et al. | 96/135 |
| 3,811,531 | A | * | 5/1974 | Forssman | 181/258 |
| 3,964,570 | A | * | 6/1976 | Morrow | 181/268 |
| 4,116,303 | A | * | 9/1978 | Trudell | 181/252 |
| 4,149,611 | A | * | 4/1979 | Taguchi | 181/252 |
| 4,162,904 | A | | 7/1979 | Clay et al. | |
| 4,164,266 | A | | 8/1979 | Collin et al. | |
| 4,241,805 | A | * | 12/1980 | Chance, Jr. | 181/232 |
| 4,278,147 | A | * | 7/1981 | Watanabe et al. | 181/256 |
| 4,628,689 | A | * | 12/1986 | Jourdan | 60/295 |
| 4,786,299 | A | * | 11/1988 | DeMarco | 96/382 |
| 4,848,513 | A | * | 7/1989 | Csaszar | 181/265 |
| 4,924,966 | A | * | 5/1990 | Kanda et al. | 181/228 |
| 5,206,467 | A | * | 4/1993 | Nagai et al. | 181/232 |
| 5,274,201 | A | * | 12/1993 | Steele | 181/224 |
| 5,559,310 | A | * | 9/1996 | Hoover et al. | 181/230 |

(Continued)

FOREIGN PATENT DOCUMENTS

DE 3729219 A1 3/1988

(Continued)

*Primary Examiner*—Edgardo San Martin
(74) *Attorney, Agent, or Firm*—Salvatore P. Pace

(57) ABSTRACT

The present invention generally relates to the attenuation of vacuum blower noise using a silencer. More particularly, the present invention relates to a low-cost, reliable and efficient silencer for reducing noise levels in adsorption-based gas separation plants from the discharge of the vacuum blower or from the feed blower inlet, to about the 90 dBA level or less, at the silencer opening to the atmosphere. The silencer includes at least one reactive chamber(s) to attenuate low frequency pulsations and at least one absorptive chamber(s) to attenuate noise at medium to high frequency noise.

9 Claims, 6 Drawing Sheets

U.S. PATENT DOCUMENTS 5,670,757 A 9/1997 Harris
5,912,368 A * 6/1999 Satarino et al. ..... 55/320
5,957,664 A 9/1999 Stolz et al.
6,089,348 A 7/2000 Bokor
6,116,376 A * 9/2000 Chu ..... 181/256
6,131,696 A * 10/2000 Esslinger ..... 181/224
6,161,646 A * 12/2000 Curl ..... 181/252
6,451,097 B1 9/2002 Andreani et al.
6,637,546 B1 * 10/2003 Wang ..... 181/264
6,719,078 B2 * 4/2004 Nakamura ..... 180/69.22

FOREIGN PATENT DOCUMENTS

GB 2 049 035 A 12/1980
GB 2 104 148 A 3/1983

* cited by examiner

SILENCER FOR ADSORPTION-BASED GAS SEPARATION SYSTEMS

TECHNICAL FIELD

The present invention generally relates to the attenuation of blower noise using a silencer in an adsorption-based gas separation system. The present invention more particularly relates to a low-cost, reliable and efficient silencer connected to the discharge of a vacuum blower or to the inlet of a feed blower of an adsorption-based gas separation plant. The silencer can reduce noise levels to about the 90 dBA level or less at the silencer opening to the atmosphere.

BACKGROUND OF THE INVENTION

Adsorption-based gas separation plants (e.g., pressure swing adsorption (PSA) systems or vacuum pressure swing adsorption (VPSA) systems) operate at various capacities. There has been and continues to be an increased demand for such plants to have higher product throughput. One way to achieve this goal is to increase the plant size, as current trends for these large tonnage plants become commercially more cost effective.

Large tonnage VPSA plants require increased blower size and/or speed. Increasing the blower size, however, also increases radiated noise and pulsations levels in the plant. Such pulsations may lead to pipe vibrations that can ultimately damage pipes, beds or other equipment such as an aftercooler in the plant. In addition, noise generated by these pulsations could be dangerous for the safety and health of plant personnel and the environment. For example, the sound pressure level at the exit of a typical large size vacuum blower can reach levels up to about 170-180 dB. For safety, environmental and/or regulatory concerns, however, the sound pressure level needs to be reduced to about 90 dBA.

To reduce pulsation, and hence the dissipated noise by the discharged gas, VPSA plants typically employ a silencer at the discharge of the vacuum blower. Current noise silencing in standard VPSA plants is provided by commercially available cylindrical steel-shell type silencers. As these silencers become larger both in length and diameter to provide the necessary sound attenuation for larger plants, they become more prone to vibrate, act as a noise source and can fail mechanically. The cost to manufacture and maintain such silencers therefore increases. Because of economics, reliability and effectiveness, steel-shell silencers do not scale-up successfully for large tonnage plants. This requires an alternative method of silencing blower noise in such plants.

U.S. Pat. No. 6,089,348 to Bokor and U.S. Pat. No. 4,162,904 to Clay et al. exhibit typical industry practice for silencing blower noise. In both of these patents, it is suggested that the blower noise can be reduced or dissipated by a steel-shell type cylindrical silencer that include multiple chambers. These types of silencers become ineffective for large blowers that generate high levels of pulsations as their shell vibrates due to blower pulsations. In addition, the cost to manufacture and maintain such silencers is adversely affected by increased blower size. Consequently, these silencers do not scale up economically for large plants.

U.S. Pat. No. 5,957,664 to Stolz et al. suggests the use of a Helmholtz resonator type pulsation dampener in the discharge conduit of the blower just before the silencer so that pulsation entering into the silencer can be dampened, and hence the performance of the silencer can be improved. Such an approach is limited, however, given that the design of such resonators is only effective at a given frequency for a specified design condition. In many instances, blowers generate pulses not only at a single frequency, but also at its harmonics.

U.S. Pat. No. 6,451,097 to Andreani et al. presents an alternative approach to attenuation of blower noise by disclosing a partially buried structure. This structure has impedance tubes and baffles to provide noise attenuation.

In view of the prior art, it would thus be desirable to provide more reliable, cost effective, and better performing silencers for use in adsorption-based gas separation plants.

BRIEF SUMMARY OF THE INVENTION

The present invention generally relates to the attenuation of vacuum blower noise using a silencer. More specifically, the present invention relates to a low-cost, reliable and efficient silencer for reducing noise level (from for example, about 170-180 dB) at the discharge of the vacuum blower in adsorption-based gas separation plants, such as vacuum pressure swing adsorption (VPSA) plants downward to satisfy safety, environmental and/or regulatory criteria (e.g., to 90 dBA). For example and while not to be construed as limiting, the present invention is expected to be well suited for use at the vacuum blower discharge of oxygen or carbon dioxide VPSA systems.

The silencer in accordance with the present invention can also be implemented at the feed inlet of adsorption-based gas separation plants (e.g. pressure swing adsorption (PSA) and/or VPSA plants). In addition, the silencer can be used in other applications, for example PSA systems for air separation that produce oxygen or nitrogen. While the silencers in accordance with the present invention can be utilized in both small tonnage plants and large tonnage plants, the benefits for noise reduction are expected to be amplified for the larger plants.

Relative to prior art systems, the present invention is expected to facilitate ease of manufacture. Moreover, higher noise attenuation is expected with silencers produced in accordance with the present invention given that these silencers include more reactive and absorptive silencing capability relative to prior art silencers.

Silencers in accordance with the present invention include both reactive chambers to attenuate low frequency pulsations and absorptive chambers to attenuate medium to high frequency noise. As used herein, a silencer is a structure in flow communication with a blower and in flow communication with the atmosphere. As used herein, a chamber is an enclosure having at least one inlet and one outlet opening. Outer and interior walls of the silencer can be formed of concrete. In contrast to steel-shelled silencers, silencers in accordance with the present invention are designed not to act as a noise source. Low frequency noise is cancelled in at least one reactive chamber that has at least one opening that serves as an inlet to the silencer and at least one opening that serves as an outlet. If two reactive chambers are positioned adjacent to one another, then the outlet of one reactive chamber will serve as the inlet to the next reactive chamber, and will be located in the dividing walls between such chambers. At least one absorptive chamber is provided and is designed to cancel noise at higher frequencies than the reactive chamber capabilities. At least one absorptive chamber has at least one inlet and one outlet, and has its interior walls lined with at least one sound absorbing material. The at least one absorptive chamber provides a flow path that promotes sound waves to be incident on the sound the absorbing material, and the flow path is of a serpentine type.

More specifically, a serpentine flow path promotes sound waves to be incident on sound absorbing surface(s) multiple times and the sound waves are absorbed much more effectively relative to straight flow passages. In preferred embodiments, interior walls of the absorptive chambers are preferably covered with sound absorbing material that effectively cancels noise at wide range of frequencies. Additionally, the interior surfaces of the reactive chamber that is in direct flow communication with an absorptive chamber can also be covered with sound absorbing material to provide both reactive and absorptive noise reduction.

Silencers of the present invention include at least one, and preferably a plurality of reactive chambers. The reactive chambers include at least one opening in the dividing walls. Such openings reduce and/or minimize pressure drop and facilitate ease of manufacture. Reactive silencing is provided in the silencer by utilizing expansions and contractions in cross-sectional areas of the gas flow path. In alternative embodiments, however, there may be only one opening in the dividing walls. While it may possible to include only one reactive chamber (e.g., in small blowers), preferred embodiments in accordance with the present invention will typically include a series of reactive chambers.

Silencers of the present invention also include at least one absorptive chamber(s). In embodiments in which there is only one absorptive chamber, the reactive chamber that is in direct flow communication with an absorptive chamber is preferably covered with absorbing material(s) such that it also provides absorptive capabilities. Specific configurations of the absorptive chambers preferably provide for a serpentine flow path. In preferred embodiments of the present invention, all of the interior walls of the absorptive chambers are covered with sound absorbing material(s). Absorptive silencing is expected to be more effective in the silencers of the present invention relative to the prior art due to presence of large interior surface area covered with the sound absorbing material(s) and the serpentine flow path.

As mentioned hereinabove and as discussed below, silencers of the present invention reduce and/or eliminate the steel-shell vibration problems characteristic of many prior art silencers. Reactive chambers in accordance with the present invention reduce the radiated sound level by reflecting the sound waves back to its source. To provide reactive silencing, the silencer utilizes expansions and contractions in cross-sectional areas of the gas flow path.

Silencers of the present invention can also be easier to manufacture than steel-shell silencers or a silencer with many internal parts. Steel-shell silencers sometimes experience failures such as cracking and failure of the outer shell, interior dividing walls and impedance tubes due to low frequency pulsations. Elimination of steel-shell construction in accordance with the present invention provides easy construction and simple interiors. Consequently, silencers of the present invention can be manufactured entirely at the plant site with a minimal or reduced number of shipped parts. Silencers of the present invention thus have both the advantages of simplicity and improved sound attenuation performance. Silencers of the present invention also provide the advantage of lower pressure drop across the silencer, which can be a significant consideration for overall plant efficiency.

Silencers of the present invention accordingly provide an important economic benefit as providing enabling technology for building large-scale adsorption-based air separation plants, such as for example $O_2$-VPSA plants. Moreover, the capital costs associated with silencers made in accordance with the present invention are expected to be lower than typical steel-shell silencers.

BRIEF DESCRIPTION OF THE DRAWINGS

For a more complete understanding of the present invention and the advantages thereof, reference should be made to the following Detailed Description taken in conjunction with the accompanying drawings in which.

DETAILED DESCRIPTION

As discussed hereinabove, the present invention relates to the attenuation of vacuum blower noise using a silencer. The present invention more specifically provides for a low-cost, reliable and efficient silencer for reducing noise levels to about 90 dBA. In exemplary embodiments of the invention, the silencer can be employed at the discharge of the vacuum blower in large tonnage oxygen VPSA plants. The silencer includes reactive chambers to attenuate low frequency pulsations and absorptive chambers to attenuate medium to high frequency noise.

Outer and interior walls of the silencer can be made of concrete, including reinforced concrete (for example, steel-reinforced concrete). Other materials of construction, however, may be suitable for use in accordance with the invention. For example and while not to be construed as limiting, brick and/or masonary blocks may be used. In addition, the material of construction may be different for the reactive and absorptive chambers. In one preferred embodiment, the reactive chambers can be formed of concrete and the absorptive chambers can be formed of masonry block. The material(s) of construction for the reactive and absorptive chambers should facilitate noise reduction. Unlike steel-shelled silencers, silencers of the present invention will not act as a noise source. Reactive chambers reduce the radiated sound level by reflecting the sound waves back to its source. To provide reactive silencing, the silencer utilizes expansions and contractions in cross-sectional areas of the gas flow path. The at least one absorptive chamber provides a serpentine flow path, and the entire interior walls of the absorptive chamber(s) are covered with sound absorbing material (e.g., fiberglass, glass wool, mineral wool, nylon fibers and/or the like) to effectively cancel noise at high frequencies.

Figure 1:
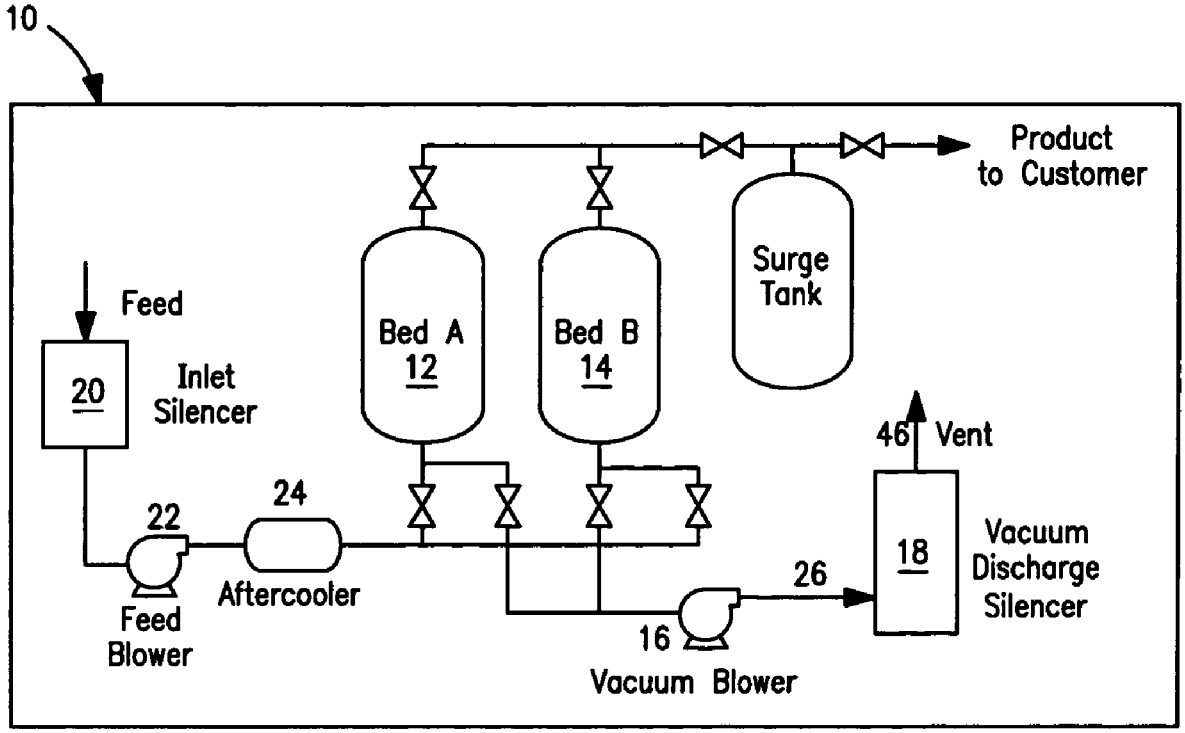
FIG. 1 illustrates an exemplary system incorporating a silencer at the discharge of a vacuum blower.

FIG. 1 illustrates a typical vacuum pressure adsorption (VPSA) system. As shown in FIG. 1, VPSA plant 10 includes one or more adsorbent beds (for example, 12, 14) that swing between adsorption and desorption cycles. During a desorption step, the bed is connected to a vacuum blower 16, which causes the adsorbed gas to desorb and to be discharged as waste gas. Such blowers displace a large quantity of gas from inlet to outlet via its pockets between its lobes and casing at relatively constant volume. The flow of gas in and out of blowers in this manner is not steady, but rather is a discrete (or intermittent) action. Due to pressure differences between the gas pockets and outlet piping, every time the rotor tips clear the housing, pressure fluctuations are created. Such fluctuations create gas pulsation and noise. These pulsations are a function of blower size and speed, in which larger blower sizes and higher rotation speeds create higher pulsation and hence louder noise levels.

To reduce the pulsation, and thus the dissipated noise by the discharged gas, VPSA plants employ a silencer 18 at the discharge of vacuum blower. The sound pressure level at the exit of a typical large size vacuum blower can reach levels up to 170-180 dB. Because of safety and environmental concerns, however, these noise levels need to be reduced to approximately 90 dBA levels.

In addition, it may also be desirable to include an inlet silencer 20, as also shown for example in FIG. 1. Silencers in accordance with the present invention can also be used as inlet silencers and positioned upstream of a feed blower 22 as shown in FIG. 1. When the silencer in accordance with the present invention is connected to the discharge of vacuum blower, gas from the vacuum blower enters the silencer through a reactive chamber and leaves the silencer through an absorptive chamber. When the silencer is connected to the intake of a feed blower, gas from the atmosphere enters the silencer through an absorptive chamber and leaves the silencer through the reactive chamber into the blower.

The overall size of a silencer is dependent on several factors, including the desired noise reduction and flow rate of a particular gas. Noise reduction depends primarily on the silencer length, and the area of the silencer is determined by the gas flow rate. As the plant size increases, the average flow through the silencer also increases. Accordingly, the area of the silencer needs to be increased to have acceptable flow velocity in the silencer.

As mentioned previously, sound attenuation in the silencers of the present invention is achieved by utilizing both reactive and absorptive sections. The reactive component(s) primarily provides peak noise reduction in low frequency range (<250 Hz) and the absorptive component(s) provides noise reduction over medium (between 250-500 Hz) and high frequency (>500 Hz) ranges.

As also mentioned hereinabove, blower size and speed dictates the size of the silencer. It will thus be appreciated by those skilled in the art that the silencer in accordance with the present invention can be modified to adjust for such criteria. While not to be construed as limiting, one exemplary embodiment includes a silencer designed for a large vacuum blower, for example a vacuum blower capable of operating at about 35000 scfm flow of air and running at speeds between about 1400 rpm and 2200 rpm. The blower can have two tri-lobe rotors, consequently primary frequency of the pulsations is six times the shaft speed. As a result, the concrete silencer can be designed to provide best noise attenuation for the frequency range of 140 Hz to 220 Hz. In addition, there is higher harmonics of these frequencies in the frequency spectrum of the sound waves, and the silencer of the present invention is also capable of attenuating such high frequency noise.

Moreover, the flow channels in such a silencer can be designed to comfortably accommodate the 35000 scfm flow of air provided by the blower. Low flow velocities inside the silencer is important both for low-pressure drop and to prevent deterioration of the sound absorbing material. As a design criteria, flow velocity at the silencer inlet is preferably kept under 75 ft/s, while average flow velocity inside the silencer at any section is kept under 15 ft/s to prevent deterioration of absorptive materials (e.g. fiberglass) on the surfaces of the absorptive chambers. In addition, the length of openings between the chambers in the absorbing section are preferably kept around one third of the chamber length to minimize the pressure drop in these chambers.

As mentioned hereinabove, the silencer can be modified to adjust for variations in applications. Silencers in accordance with the present invention can accordingly be designed as a scalable structure and can easily be designed to be effective at other blower speeds (i.e. other effective frequency ranges) and flow rates. Silencers incorporating the features of the present invention can also be designed for use at the feed inlet as discussed hereinabove.

By design, a silencer according to the present invention could be located right at the discharge of the vacuum blower with minimum piping connection. This could be particularly advantageous to prevent resonance in piping connections from the blower to the silencer. The length of such piping should not be equal to or close to the quarter wavelength of the pulses. In this manner, piping pulsations will be minimized. To save space and to provide additional soundproofing, the silencer and particularly its reactive sections can be placed underground. The silencer can extend either vertically or horizontally.

Figure 2:
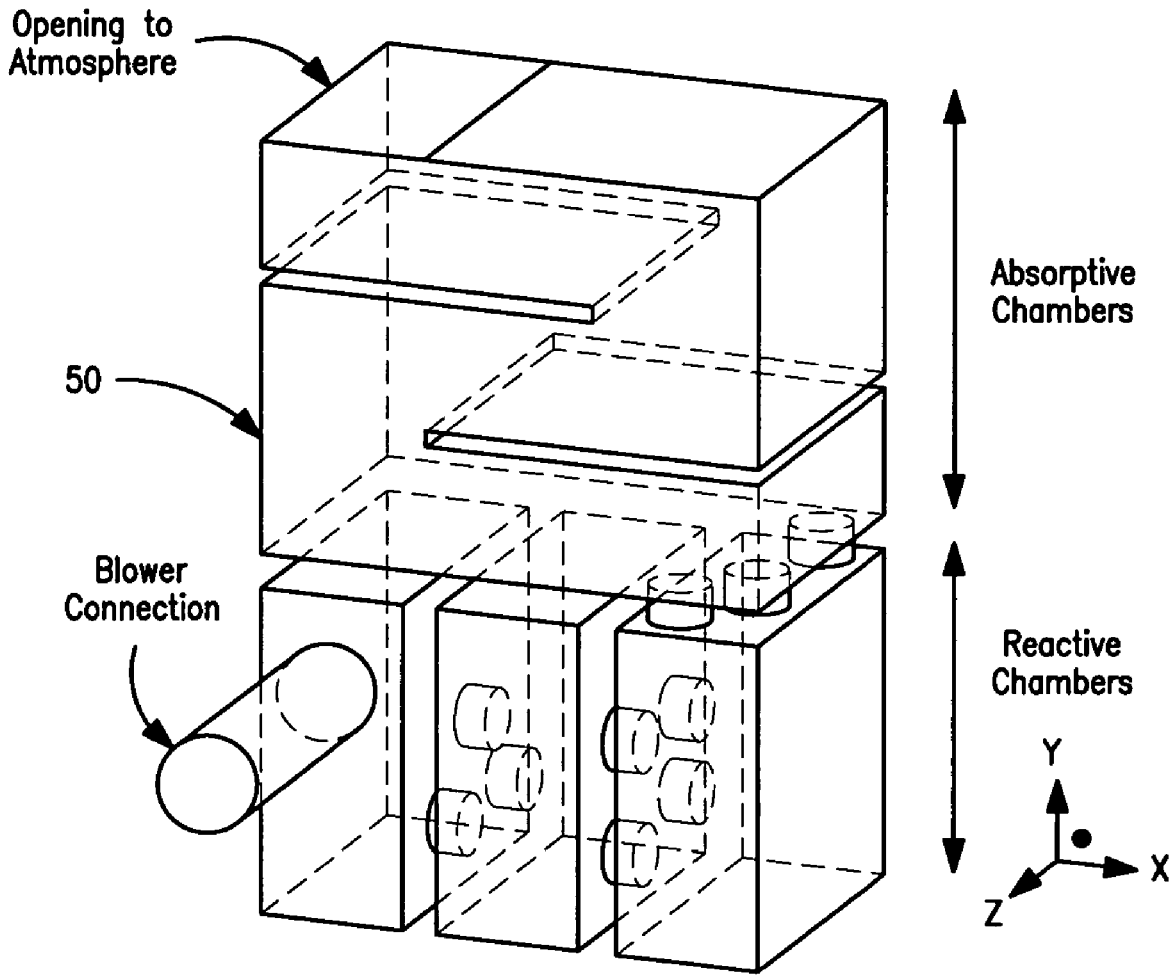
FIG. 2 illustrates a silencer in accordance with one embodiment of the present invention.
Figure 4:
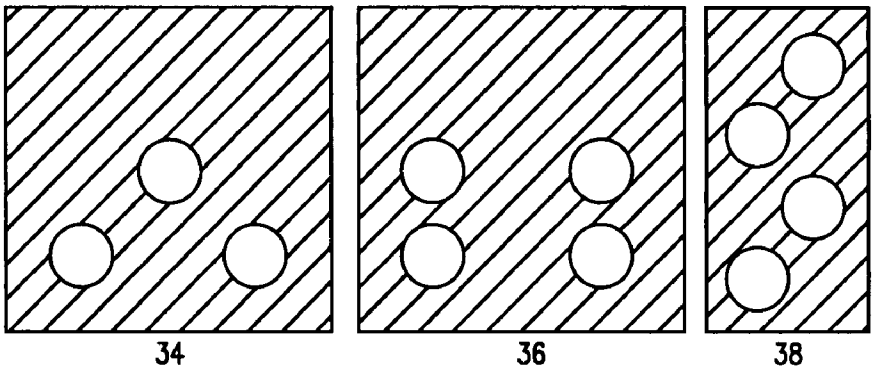
FIG. 4 shows a view of exemplary positioning of openings in the reactive chambers in accordance with one embodiment suitable for use in accordance with the present invention.
Figure 3:
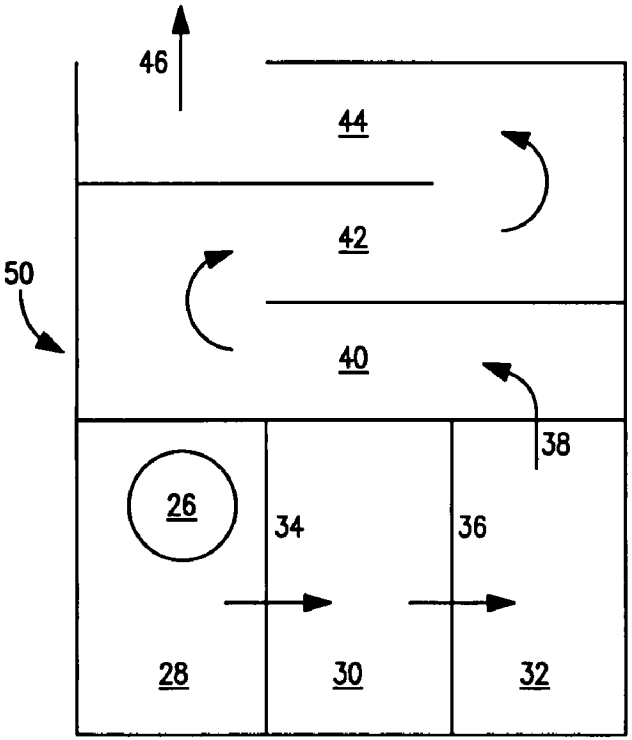
FIG. 3 shows the gas flow path in accordance with the silencer of FIG. 2 for use with a vacuum blower.

An illustrative and non-limiting geometry of a silencer 50 for the aforementioned blower is shown in FIGS. 2-4. An exemplary footprint for a blower having the capabilities mentioned above (i.e., operation at 35000 scfm flow of air and between 1400-2200 rpm) is expected to be about 12'-by-17' and 24' of height with a wall thickness of about 12".

As the blower discharges the waste gas, pulsating flow enters into the silencer through inlet opening 26 and it expands into the reactive chamber 28. In the embodiment shown, there are three reactive chambers (28, 30, 32) in the lower section of the silencer. Dividing walls (34, 36, 38) of each of these chambers can have at least one opening (for example, multiple 2'-diameter openings). An exemplary view of these walls is shown in FIG. 4. It will be appreciated by those skilled in the art that other arrangements for the opening(s) in the dividing walls of such chambers can be designed for use in accordance with the present invention. The geometry of the dividing walls provide expansion and contraction in cross-sectional areas of the gas flow path in a series of chambers as discussed above. By doing so, the low frequency noise and pulsations are attenuated. This is the underlying principle of reactive silencing. In addition, the total area of the opening(s) of the outlet is designed to be about 33% larger than the inlet to minimize pressure drop. For example and in one illustrative embodiment, chamber 30 has three openings (e.g., 2'-diameter openings) on the dividing wall 34 on the inlet side, whereas on the dividing wall 36 on the outlet side, there are four such openings.

As further shown in FIGS. 2-4, there are also multiple absorptive chambers (40, 42, 44) in the silencer 50. Each absorptive chamber (40, 42, 44) has its interior surfaces lined with sound absorbing material(s) (e.g. fiberglass). Such lining is sufficiently thick (e.g. 2-inches thick in some embodiments) in order to facilitate noise reduction in the medium to high frequency range (>250 Hz). In these chambers, high frequency noise is primarily attenuated by sound absorption. The size of these chambers is designed to provide low flow velocities of the gas so that it will not deteriorate the absorbing material(s) and will lead to lower pressure drop.

Waste gas is discharged to the atmosphere through opening 46 at the top of the silencer. If the silencer is designed as an underground unit or a partially underground unit, then the outlet opening 46 needs to extend well above the ground level so as not to cause nitrogen asphyxiation. For the above ground designs, a rain cover at this outlet should suffice for most applications.

In the silencer for the above-mentioned blower, there are three reactive chambers in series. Regardless of the number of chambers, reactive chambers reduce the radiated sound level by reflecting the sound waves back to its source. To provide reactive silencing, the silencer utilizes expansion and contraction in cross-sectional areas of the gas flow path. Reactive chambers are primarily effective to attenuate low frequency noise (150-250 Hz).

As well known by one-dimensional muffler theory, the magnitude of transmission loss in a single reactive chamber is determined by the size of inlet, outlet, and chamber areas, whereas the length of the chamber determines the effective frequency range of the silencer. For this reason, selection of chamber length is very important for effective silencing. If the length of the chamber is equal to quarter-multiples of the wave-length ($L=\lambda/4, 3\lambda/4, 5\lambda/4, \ldots$), the transmission loss will be at a maximum. On the other hand, if the chamber length is equal to half-multiples of the wave-length ($L=\lambda/2, \lambda, 3\lambda/2, \ldots$), transmission loss will be zero.

Figure 5:
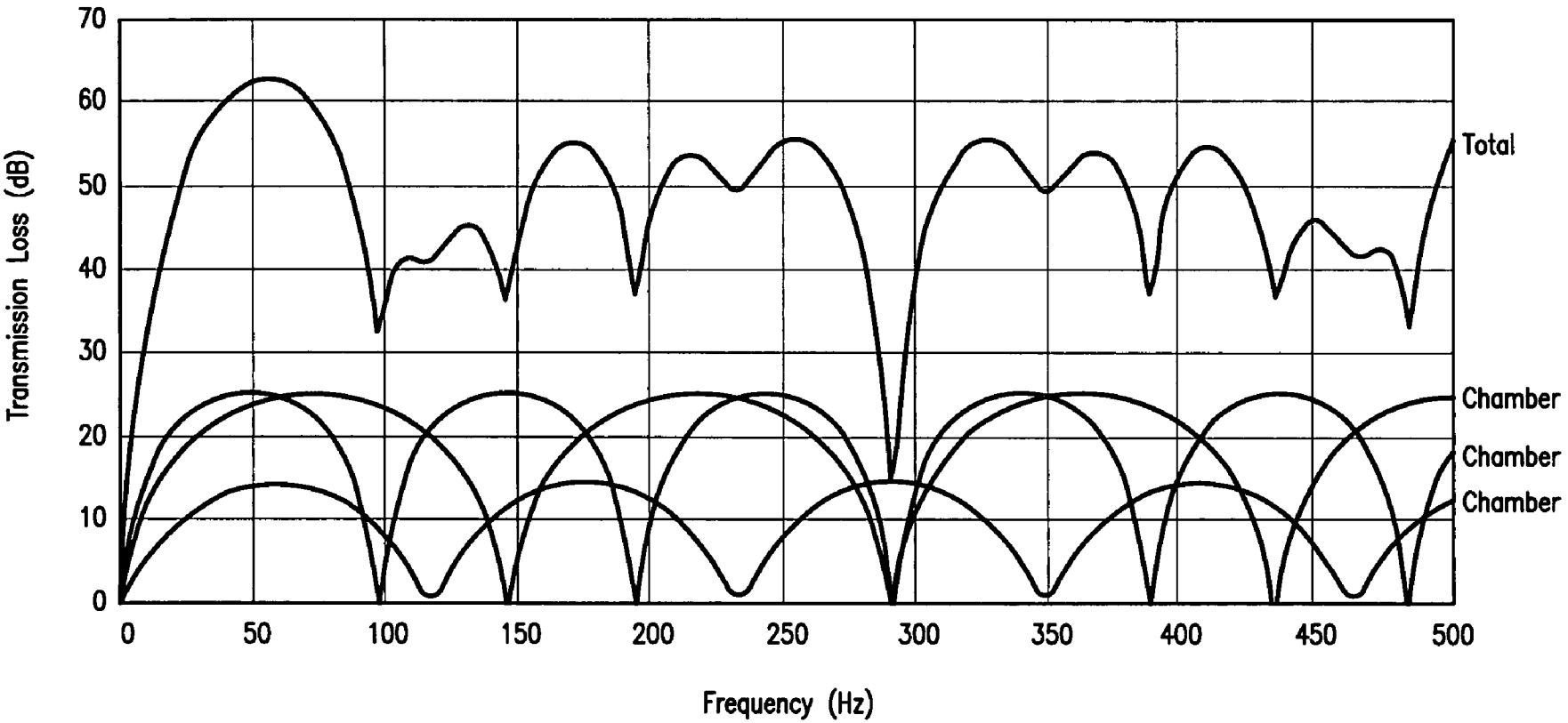
FIG. 5 shows a graph of theoretically calculated transmission loss (dB) vs. frequency (Hz) for the reactive chambers.

Keeping this theory in mind, each of the three reactive chambers is designed to provide the desired level of transmission loss in the frequency range of interest. Total transmission loss provided by the number of reactive chambers (e.g. three) is the summation of each of the number (e.g. three) of transmission losses. Calculated theoretical transmission loss (sound attenuation) as a function of frequency of sound waves by each of the three chambers for the embodiment described above and their summation are shown in FIG. 5. The reactive chambers are designed to provide roughly 40-50 dB transmission loss in the frequency range of interest of 150-250 Hz.

Absorptive chambers attenuate the sound by converting the acoustical energy into heat by friction in the voids between the oscillating gas particles and fibrous/porous sound absorbing material. Absorptive silencers are effective in attenuating medium and high frequency noise.

In the exemplary silencer discussed above, sound attenuation by absorption takes place in the three upper plenum chambers. Inside surfaces of these chambers are lined with absorptive material (e.g., 2" thick fiberglass). In the test unit described in the example below, only bare fiberglass panels are installed since the unit will be used for relatively short periods of time. Absorbing materials such as fiberglass surfaces, however, can be covered with perforated sheets (e.g., perforated thin metal sheets) to provide additional protection of the absorbing material(s) from surface damage. Such perforations can preferably be in the range of 25-50% open area.

Figure 6:
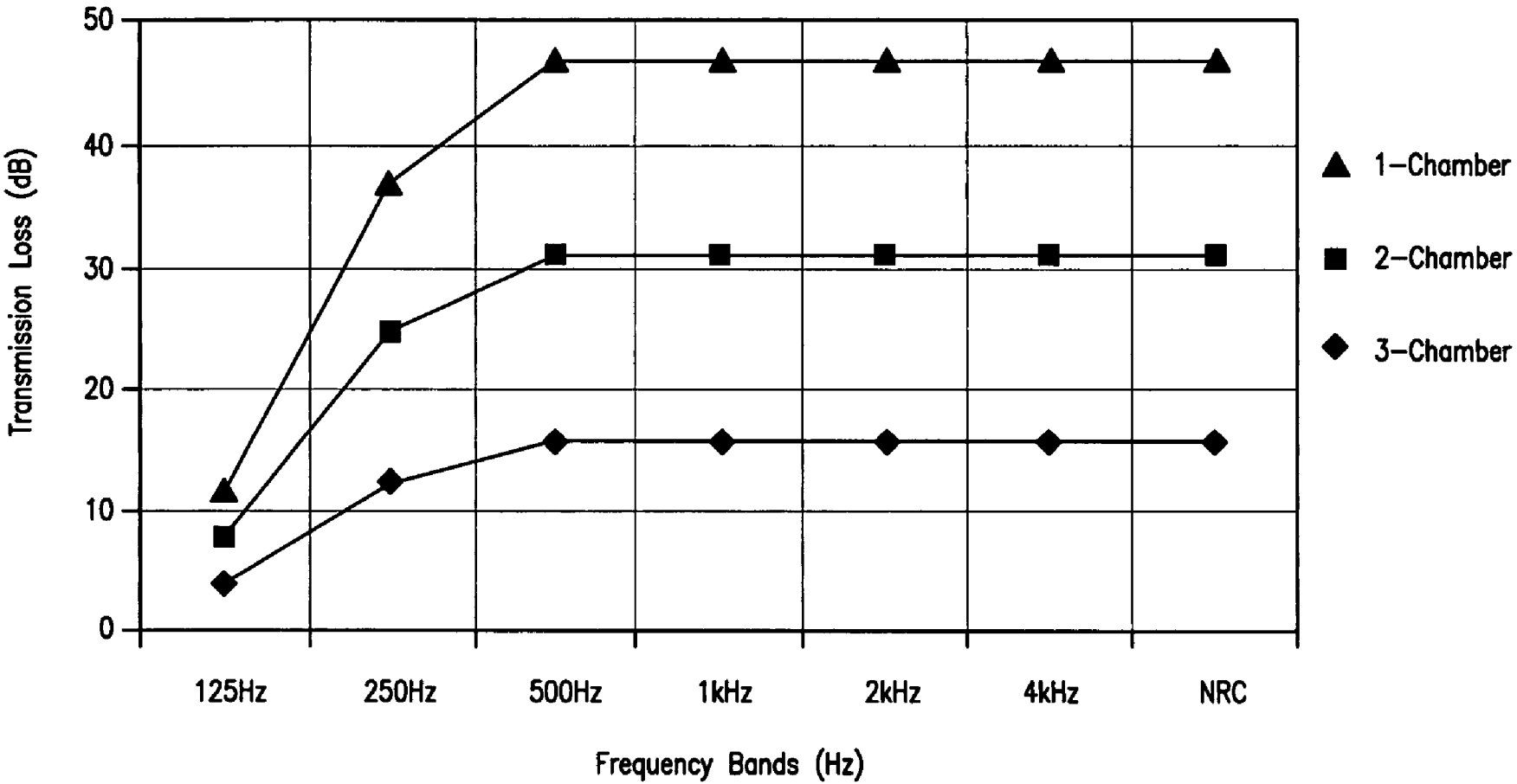
FIG. 6 shows a graph of theoretically calculated transmission loss (dB) vs. frequency bands (Hz) for absorptive chambers.

As mentioned above, commercially available materials other than fiberglass can also be employed as a sound absorbing material. One important criteria when using fiberglass or fiberglass-like material is that the material should withstand flow velocities up to about 40 ft/s. Additionally, its sound absorbing properties should not deteriorate at elevated temperatures up to about 300 F. Materials other than fiberglass, such as mineral wool, nylon fibers or the like can be also be used as a sound absorbing material in the absorptive chambers as long as the sound absorption properties of the material do not deteriorate at temperatures exiting the blower (for example about 300° F.) and with high surface velocities. Combinations of such materials can likewise be used. In some specific embodiments, absorptive chambers are designed to collectively provide about 50 dB sound attenuation. More generally, however, the geometry of the chamber and the sound absorption coefficient of the absorptive material determine the total attenuation (transmission loss) provided by absorptive chamber(s). Expected calculated transmission loss for each octave band for the case of one, two and three chambers is shown in the FIG. 6. As illustrated in FIG. 6, absorptive chambers are more effective at higher frequencies than lower frequencies (e.g., a three-chamber absorptive section can provide 25-30 dB sound attenuation in the frequency range of interest of 140-220 Hz, as opposed to close to 50 dB for higher frequency). Practically, however, the total attenuation will likely be higher since incoming sound waves are not pure low frequency noise, but also have higher frequency noise due to other harmonics.

Another important factor to consider in designing a silencer is the amount of pressure drop (or back pressure) induced by the silencer at the exit of the blower. Lower pressure drop can be desirable for higher overall plant efficiency. Both computational simulations and experimental results suggest that the exemplary silencer designed with three reactive-chamber in series with three absorptive plenum chambers gives about 0.15 psi pressure drop at peak flow conditions. As expected, the majority of the pressure drop takes place in the reactive chambers due to multiple expansion and contraction of the flow. This is much less than the pressure drop of some typical steel-shell type silencers. Because plants are not running at peak flow rates continuously, the average pressure drop is expected to be less, and in some cases, much less.

The unit can be built as a vertically extending structure. The silencer can also be built as a horizontally extending structure or a combination of vertically and horizontally extending structures. With vertical extension, a multitude of sections can be built on a very limited footprint. This may be advantageous when space is limited. Alternatively, a horizontally extending structure can be placed under the ground to save space. Additionally, an underground unit will provide the advantage of additional soundproofing by soil. The silencer can also be designed as a partially underground unit, with for example reactive chambers being placed underground since primarily low frequency pulsations are in these chambers. Various different arrangements can be made depending on the available space in the plant area. In some places, the plant space could be very limited while in others such limitations may not exist.

As set forth below, the walls dividing the chambers in the reactive sections of the test unit have multiple circular 2 foot-diameter openings. The shape of these openings, however, can be rectangular or any other shape so long as the total area of the outlet opening(s) of a chamber are about 33% more than inlet opening(s) (for pressure drop consideration). For purposes of illustration, there can be more than three holes on the dividing wall 34, or more than four holes on the second 36 and third 38 dividing walls. If the number of holes is increased, then the size of the holes should be decreased accordingly to keep about the same total open area on the walls.

Current geometry of the silencing chambers provides necessary sound cancellation in the reactive chambers. In addition, impedance tubes can be placed in the openings to improve transmission loss in the frequency range of interest. The relative lengths of the tubes and chambers together with wavelength of the sound waves determine the improvement in the noise attenuation. The length of the tube(s) in each chamber should preferably be one-half of the chamber length to provide maximum attenuation. Having perforations in the surface of the tubes can further increase the noise attenuation.

The thickness of the concrete walls in the test unit described below is 12". This thickness is partly due to providing structural support for the vertically extending silencer. In the case of a horizontally extending or underground unit, the wall thickness can be less, 6" to 8" thick compared to 12" thick.

In the example below, the unit included three reactive and three absorptive chambers. The number of chambers can be decreased or increased to provide the necessary noise attenuation. Alternatively, some of these chambers can be designed to provide both reactive and absorptive noise attenuation. For example, interior surfaces of the later stages of reactive chambers proximate to the absorptive chambers can be covered with sound absorbing material to improve the noise attenuation in these chambers. Such reactive chamber should preferably be the reactive chamber that is in direct flow communication with the absorptive chamber since the level of pulsations should be substantially diminished so as not to damage the absorbing material or its installation. Accordingly, such chambers can provide both reactive and absorptive sound attenuation.

Particular sizes of the chambers and silencer in the example below are specifically designed for a large blower that under nominal operating conditions provides 35000 scfm. For larger or smaller blower sizes, the silencer can be designed by simply conserving the ratio of volumetric flow rates in all flow sections. That is, for example, using a blower that provides 25% higher output leads to 25% increase in the flow area.

To increase the absorptive silencing, interior vertical and horizontal wall panels can be placed inside the absorptive chambers as discussed above. Such walls divide the flow areas into two, three, four or any number of sections, and both sides of these dividing walls can be covered with sound absorbing material(s) to provide additional noise attenuation.

EXAMPLE

To validate analytical estimates, an experimental study was performed by building a test unit of the concrete silencer with the aforementioned size and geometry. More specifically, the silencer included three reactive chambers and three absorptive chambers lined with 2" thick fiberglass as shown in FIGS. 2-4. The silencer was designed for operation with a blower capable of operation at 35000 scfm flow of air at 1400-2200 rpm.

Pressure pulsation sensors were placed at each chamber to measure sound pressure level and thus the effectiveness of each chamber. The measurements were performed for various rotation speeds of the rotor with different vacuum conditions of the blower.

Figure 7:
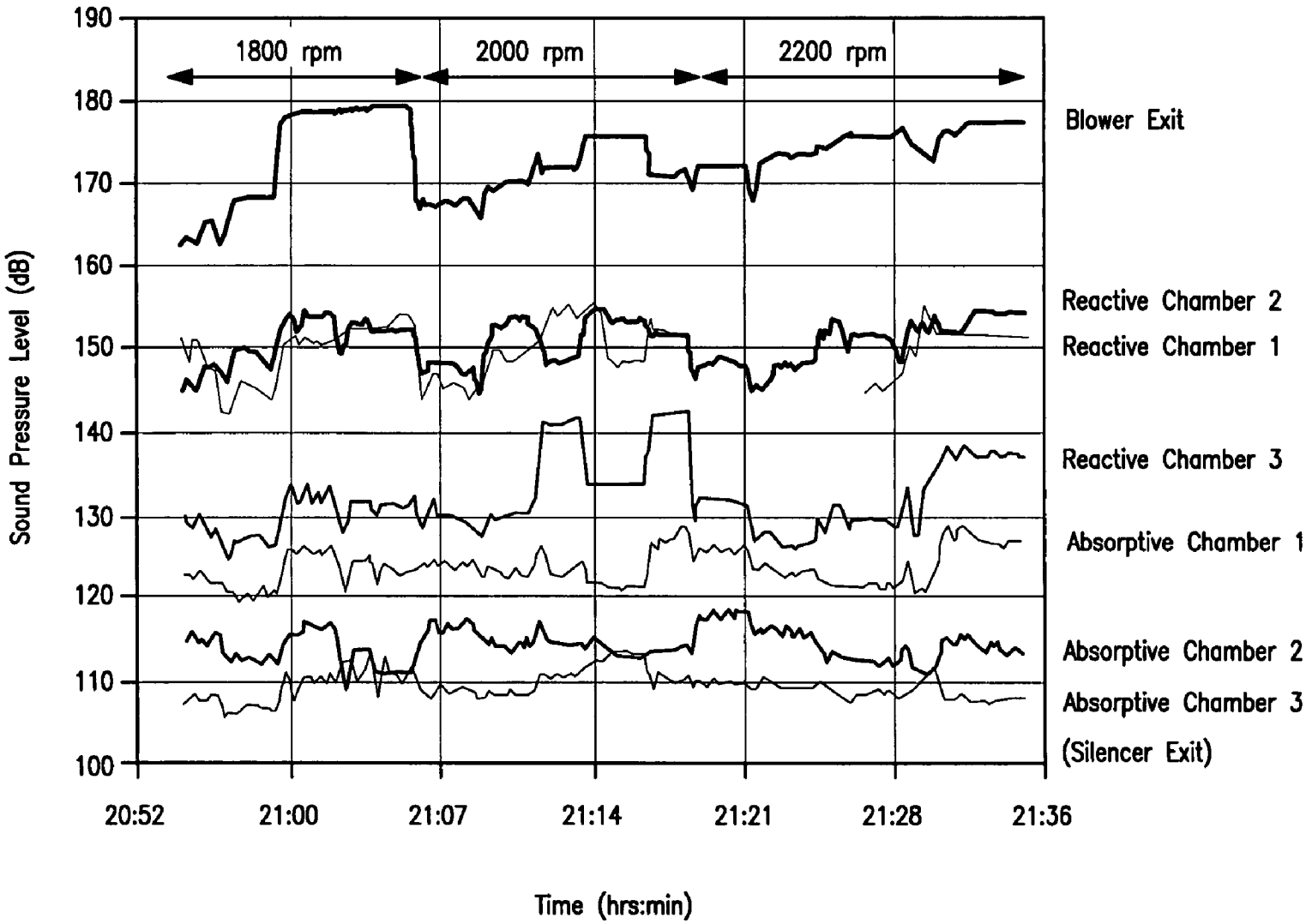
FIG. 7 illustrates experimentally measured sound pressure level (dB) vs. time for a test unit in accordance with the present invention as described hereinbelow.

FIG. 7 shows test results of sound pressure level for blower exit and exit of each chamber in the silencer for blower speeds of 1800, 2000 and 2200 rpm, and the blower inlet being operated at pressures of 1, 3, 5 and 7 psi (while the speed was fixed at 1800 rpm, the valve was set for 1 psi, the data recorded, and then valve switched to 3 psi, data recorded, and the like for 5 psi and 7 psi). Comparing the measured sound pressure levels between the blower exit (first from the top) and chamber 3 exit (fourth from the top) provides the effectiveness of the three reactive chambers in combination. As designed, the reactive chambers collectively provided roughly 40-50 dB noise attenuation. Similarly comparing sound pressure levels between the exits of chamber 3 (fourth from the top) and chamber 6 (the final chamber) displays the collective effectiveness of the three absorbing chambers. Measured results suggest roughly 20-25 dB sound attenuation by absorbing chambers. It is also important to note that the sound pressure level measured at the silencer exit is influenced by blower and motor noise, for example measurements inside the last chamber of the silencer suggest roughly 10 dB higher noise attenuation by the absorbing chambers relative to a few feet outside the silencer exit. The test unit was located indoors. Consequently, test results may be impacted relative to an outdoor unit. Both of the measured results for the reactive and absorptive chambers, however, agree well with the analytical estimates.

It should be appreciated by those skilled in the art that the specific embodiments disclosed above may be readily utilized as a basis for modifying or designing other structures for carrying out the same purposes of the present invention. It should also be realized by those skilled in the art that such equivalent constructions do not depart from the spirit and scope of the invention as set forth in the appended claims.

What is claimed is:

1. A silencer for attenuating noise in a gas separation system, the silencer comprising:

a shell;

a silencer inlet opening;

a plurality of reactive chambers disposed within the shell, each reactive chamber separated from another reactive chamber by a dividing wall, each dividing wall including a plurality of outlet and inlet openings therein, with the outlet and inlet openings dimensioned such that the total area of the outlet openings is about 33% larger than the total area of the inlet openings to effect a low flow velocity and a low pressure drop in the gas separation system, such that a flow velocity at the silencer inlet opening is restricted to an average flow velocity of about under 75 ft/s, while the average flow velocity inside the silencer is kept under about under 15 ft/s; and a plurality of absorptive chambers, wherein the plurality of the absorptive chambers having one or more dividing walls and provide for a serpentine flow channel through the plurality of absorptive chambers;

wherein the shell and the dividing walls are formed of concrete and the at least one absorptive chamber is covered with a sound absorbing material to reduce noise levels to below about 90 dBA.

2. The silencer of claim 1, wherein the at least one covered absorptive chamber absorbs and reduces noise at frequencies above 250 Hz.

3. The silencer of claim 1, wherein the sound absorbing material is selected from the group comprising: fiberglass, glass wool, mineral wool and nylon fibers.

4. The silencer of claim 3, wherein the at least one covered absorptive chamber further includes a perforated metal sheet disposed on a surface of the sound absorbing material.

5. The silencer of claim 4, wherein the perforated metal sheet contains about 25-50% open area.

6. The silencer of claim 1, wherein the silencer attenuates noise from a blower in an adsorption-based gas separation system.

7. The silencer of claim 6, wherein the adsorption-based gas separation plant is a vacuum pressure swing adsorption (VPSA) system.

8. The silencer of claim 6, wherein the adsorption-based gas separation system is a pressure swing adsorption (PSA) system.

9. The silencer of claim 1, wherein at least one opening in the dividing walls between the reactive chambers contains an impedance tube.

* * * * *